US006599121B2

(12) United States Patent
Gutmark et al.

(10) Patent No.: US 6,599,121 B2
(45) Date of Patent: Jul. 29, 2003

(54) PREMIX BURNER

(75) Inventors: Ephraim Gutmark, Baton Rouge, LA (US); Christian Oliver Paschereit, Baden (CH); Wolfgang Weisenstein, Remetschwil (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/932,094

(22) Filed: Aug. 20, 2001

(65) Prior Publication Data

US 2002/0026796 A1 Mar. 7, 2002

(30) Foreign Application Priority Data

Aug. 21, 2000 (DE) ..... 100 40 869

(51) Int. Cl.[7] ..... F23D 14/02
(52) U.S. Cl. ..... 431/182; 60/737
(58) Field of Search ..... 60/737, 738, 746, 60/39.463, 750; 431/182, 183

(56) References Cited

U.S. PATENT DOCUMENTS

| | | | | |
|---|---|---|---|---|
| 2,260,062 A | | 10/1941 | Stillman | |
| 5,000,679 A | * | 3/1991 | Fukuda et al. | 431/182 |
| 5,044,935 A | * | 9/1991 | Peter | 431/182 |
| 5,118,283 A | * | 6/1992 | Sattelmayer | 431/182 |
| 5,127,821 A | * | 7/1992 | Keller | 431/182 |
| 5,375,995 A | * | 12/1994 | Dobbeling et al. | 60/737 |
| 5,433,596 A | * | 7/1995 | Dobbeling et al. | 431/182 |
| 5,638,682 A | | 6/1997 | Joshi et al. | |
| 5,735,687 A | | 4/1998 | Knöpfel et al. | |
| 5,983,643 A | | 11/1999 | Kiesow | |
| 5,996,352 A | | 12/1999 | Coughlan et al. | |
| 6,027,331 A | * | 2/2000 | Dobbeling et al. | 431/182 |
| 6,038,861 A | | 3/2000 | Amos et al. | |
| 6,098,406 A | * | 8/2000 | Bolis et al. | 60/737 |
| 6,270,338 B1 | * | 8/2001 | Eroglu et al. | 60/737 |

FOREIGN PATENT DOCUMENTS

| | | |
|---|---|---|
| DE | 19615910 A1 | 10/1997 |
| EP | 0845634 A2 | 6/1998 |
| EP | 0985876 A1 | 3/2000 |
| WO | WO99/49264 | 9/1999 |

OTHER PUBLICATIONS

United States Statutory Invention Registration, Schadow et al., No. H1008, published Jan. 7, 1992.

* cited by examiner

*Primary Examiner*—Michael Koczo
(74) *Attorney, Agent, or Firm*—Burns, Doane, Swecker & Mathis, L.L.P.

(57) ABSTRACT

The subject of the invention is a method as well as an apparatus for suppressing flow vortices within a turbo power machine with a premix burner, into which fuel and air are introduced for mixing, which then leave the burner downstream along its burner axis in the form of a fuel/air mixture through a burner outlet and flow into a combustor located downstream from the burner in the flow direction of the fuel/air mixture. The invention is based on the basic idea of—for the fluid-mechanical stabilization of a premix burner, into which at least one combustion air stream (5) is fed tangentially into a burner chamber (6) and is mixed with an injected gaseous and/or liquid fuel (7;8) while forming a swirl flow (9) oriented coaxially to the burner axis and induces a reverse flow zone (15) at a change in the cross-section on a burner mouth (14), that is used during the operation of the burner to stabilize the flame—increasingly, radially deforming the swirl flow (9) within the burner chamber (6) in the direction of the burner mouth (14) and let it enter the combustor (12) in a non-rotation-symmetrical flow cross-section, whereby this deformation is created by reducing the free flow cross-section (18) of the burner chamber (6). The fuel/air mixture flows into the combustor with a non-rotation-symmetrical flow cross-section.

15 Claims, 10 Drawing Sheets

PREMIX BURNER

This application claims priority under 35 U.S.C. §§119 and/or 365 of Appln. No. 100 40 869.9 filed in Germany on Aug. 21, 2000, the entire content of which is hereby incorporated by reference.

FIELD OF THE INVENTION

The invention relates to a method for the fluid-mechanical stabilization of a premix burner, into which a combustion air stream is fed tangentially into an interior burner chamber, is mixed with an injected gaseous and/or liquid fuel while forming a coaxially oriented swirl flow and induces a reverse flow zone at a burner outlet that is used during the operation of the burner to stabilize the flame. The invention furthermore relates to a premix burner for performing the method. A preferred field of application of the invention is the operation of a gas turbine system.

BACKGROUND OF THE INVENTION

Premix burners of the type discussed here are known from EP 0 321 809 and EP 0 780 629. Such burners, characterized by very low noxious emissions, are used widely in combustors of gas turbine systems for hot gas generation.

When operating gas turbine systems, thermoacoustic oscillations often occur in the combustors. Fluid-mechanical instability waves created at the burner result in the formation of flow vortices that have a major effect on the entire combustion process and result in undesirable, periodic heat releases within the combustor that are associated with major fluctuations in pressure. The high fluctuations in pressure are coupled with high oscillation amplitudes that can lead to undesirable effects, such as, for example, a high mechanical load on the combustor housing, increased $NO_x$ emissions caused by inhomogeneous combustion, and even an extinction of the flame within the combustor.

Thermoacoustic oscillations are based at least in part on flow instabilities of the burner flow that express themselves as coherent flow structures and influence the mixing processes between air and fuel. In standard combustors, cooling air is passed in the form of a cooling air film over the combustor walls. In addition to the cooling effect, the cooling air film also has a sound-dampening effect and helps to reduce thermoacoustic oscillations. In modern high-efficiency gas turbine combustors with low emissions and constant temperature distribution at the turbine inlet, the cooling air flow into the combustor is clearly reduced, and the entire air is passed through the burner. However, at the same time the sound-dampening cooling air film is reduced, causing a reduction in the sound-dampening effect so that there is once again an increase in the problems associated with undesirable oscillations.

Another possibility for dampening the sound is the connection of so-called Helmholtz resonators near the combustor or cooling air supply. However, because of tight space conditions, it is very difficult to provide such Helmholtz resonators in modern combustion chamber designs.

It is also known that the fluidic instabilities and associated pressure fluctuations occurring in the burner can be countered by stabilizing the fuel flame with an additional injection of fuel. Such an injection of additional fuel is performed through the head stage of the burner that is provided with a jet for the pilot fuel gas supply located on the burner axis; however, this results in an over-rich central flame stabilization zone. This method of reducing thermoacoustic oscillation amplitudes has the disadvantage, however, that the injection of fuel at the head stage may be associated with increased $NO_x$ emissions.

Closer studies regarding the formation of thermoacoustic oscillations have shown that such undesirable, coherent structures are formed during mixing processes. Of special significance hereby are the shear layers forming between two mixing flows, which are formed within the coherent structures. More detailed explanations regarding this phenomenon can be found in the following publications: Oster & Wygnansky, 1982, "The forced mixing layer between parallel streams," Journal of Fluid Mechanics, Vol. 123, 91–130; Paschereit et al., 1995, "Experimental investigation of subharmonic resonance in an axisymmetric jet," Journal of Fluid Mechanics, Vol. 283, 365–407.

As can be seen from the previous articles, it is possible to influence the coherent structures forming within the shear layers by introducing an acoustic excitation in a targeted manner in such a way that their formation is prevented. Another method is the introduction of an acoustic anti-sound field so that the existing, undesired sound field is properly extinguished by a phase-shifted sound field that has been introduced in a targeted manner. The anti-sound technique, as described, requires a relatively high amount of energy, however, which must be provided to the burner system either externally or must be branched off from the entire system at a different point, which, however, will result in a small, yet existing, loss of efficiency.

In addition to the previous active methods for specifically reducing the coherent structures forming inside burners, such interferences in the burner flow alternatively can be countered with passive measures. Passive measures, i.e., primarily constructive design characteristics of the burners, that extend the operating range of a burner with respect to pulsations and emissions are especially attractive, since, once installed, they do not require any additional maintenance.

SUMMARY OF THE INVENTION

The invention is based on the objective of creating a method for increasing the fluidic stability of a premix burner, which efficiently and without further energy consumption suppresses the undesired flow eddies that form as coherent pressure fluctuation structures. The measures necessary on a premix burner for this purpose should be simple to construct and cheap to realize. The measures used also should be completely maintenance-free.

According to the invention, the objective is realized with a method for increasing the fluidic stability of a premix burner as well as with a premix burner of the type mentioned in the independent claims. Characteristics that constitute advantageous further development of the concept of the invention are described in the dependent claims and the specification, as well as in the exemplary embodiments.

The method according to the invention is based on the basic idea of—for the fluid-mechanical stabilization of a premix burner, into which at least one combustion air stream is fed tangentially into a burner chamber and is mixed with an injected gaseous and/or liquid fuel while forming a swirl flow oriented coaxially to the burner axis and induces a reverse flow zone at a change in the cross-section on a burner mouth, that is used during the operation of the burner to stabilize the flame—increasingly, radially deforming the swirl flow within the burner chamber in the direction of the burner mouth towards at least one circumferential section and let it enter the combustor in a non-rotation-symmetrical flow cross-section, whereby this deformation is created by reducing the free flow cross-section of the burner chamber.

The formation of coherent vortex structures is hindered by a shape of the flow cross-section that deviates from the rotation symmetry in the burner chamber and on entering the combustor. In premix burners according to the state of the art, the time delay of the fuel from the injection point to the flame is constant at certain operating points. The deformation of the flow-cross-section according to the invention results in a broad distribution of the delay time. The prevention of the formation of vortex structures at the burner outlet and a smudged time delay also suppresses a periodic heat release, which again is responsible for the occurrence of thermoacoustic oscillations. By forcing the deformation of the swirl flow through constricting sections of the chamber contour, as will still be explained at another place, this results in an acceleration of the flow, which acts in a stabilizing manner on the reverse flow zone.

A premix burner according to the invention is based on a premix burner for use in a heat generator, comprising essentially a swirl flow generator with means for the tangential introduction of at least one gaseous and/or liquid fuel into the combustion air stream with concomitant formation of a swirl flow with an axial movement component up to the burner mouth, at which the swirl flow bursts while inducing a reverse flow zone. A burner according to this type, based on at least two hollow, conically expanding partial bodies stacked inside each other in the flow direction of the hot gases, the center axes of which extend offset to each other, is described in EP 0321809, which is an integrated part of this application. Such burner types, also called cone burners or double cone burners, are provided at their burner outlet with a separation edge, whose edge contour consists of two semi-circles, offset from each other, but whose edge contour is almost circular and therefore approximately rotation-symmetrical to the burner axis when closed. The fuel/gas mixture forming inside the burner chamber spreads in the form of a rotation-symmetrical swirl flow with an axial component towards the burner mouth, with all its known disadvantages with respect to the formation of coherent structures and associated thermoacoustic pressure fluctuations.

If, however, it is ensured that targeted radial deformations are introduced into the flow of the fuel/air mixture in such a way that the flow cross-section differs from that of an rotation-symmetrical flow, the formation of coherent structures and a constant time-delay of the fuel can be effectively countered in this way.

Such an influencing of the flow geometry can be achieved with at least one section of the chamber wall, where said wall section has a smaller slope in a down-stream end part of the burner chamber than in an upstream part. In this way, this at least one section, in contrast to those wall sections at the same axis level that do not possess this property, results in a radial deviation from the circular shape in the direction towards the burner axis. Any partial non-circular contours in the burner chamber and at the outlet edge, for example, straight or spherically curved edge sections along the circumference, help in reducing flow vortices.

It should be observed as a principal design rule for designing the burner outlet edge that the geometrical deviation from a circular geometry should be chosen at least so large that the resulting distance between the two geometries is greater than the boundary layer thickness of the flow that flows through the outlet geometry.

BRIEF DESCRIPTION OF THE DRAWINGS

The invention is described in an exemplary manner below with the help of exemplary embodiments in reference to the drawing, without limiting the general concept of the invention whereby.

DETAILED DESCRIPTION OF THE INVENTION

Figure 1A:
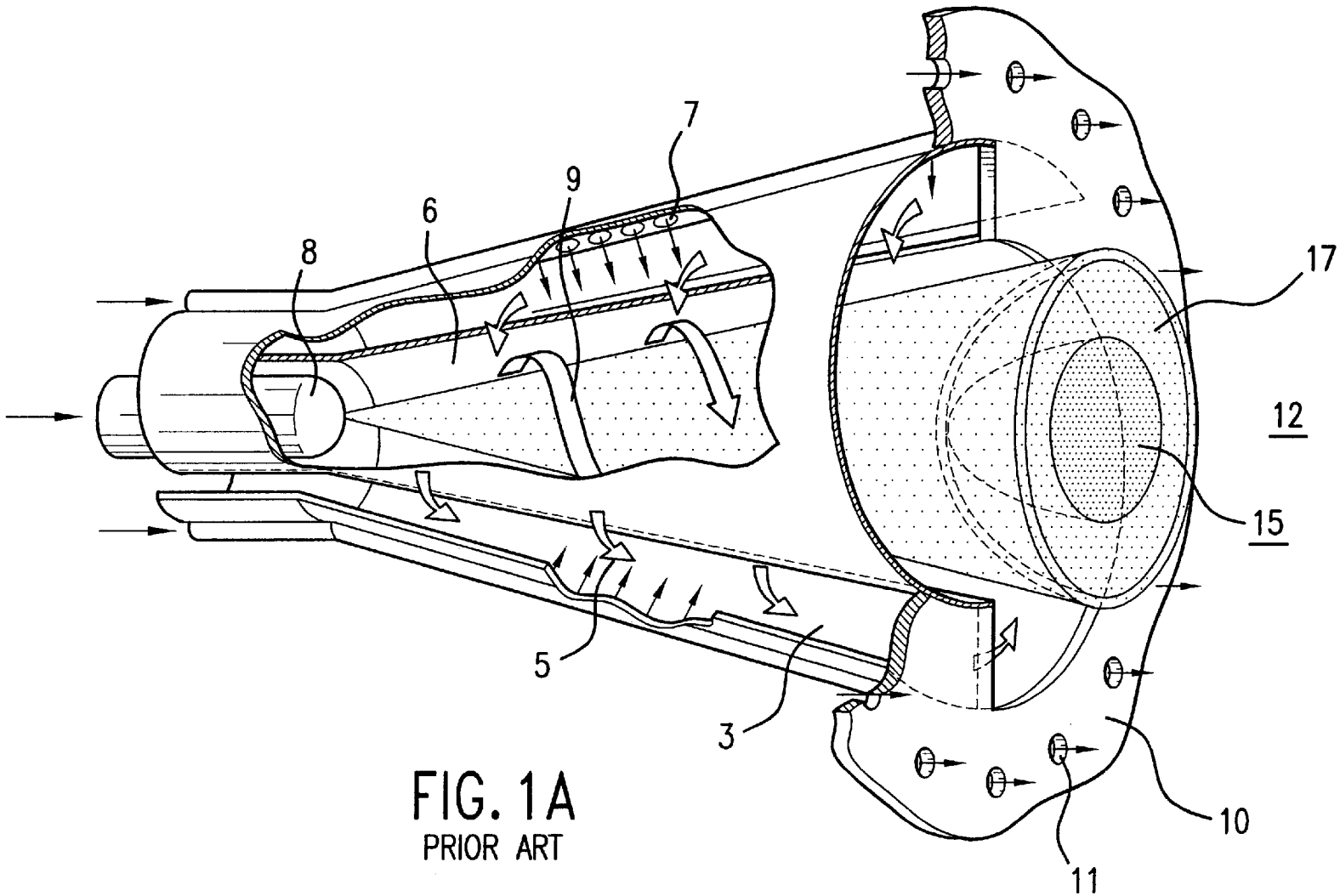
FIG. 1A PRIOR ART
FIG. 1*a* shows a perspective drawing of a premix burner according to the state of the art, on which the invention is based.
Figure 1B:
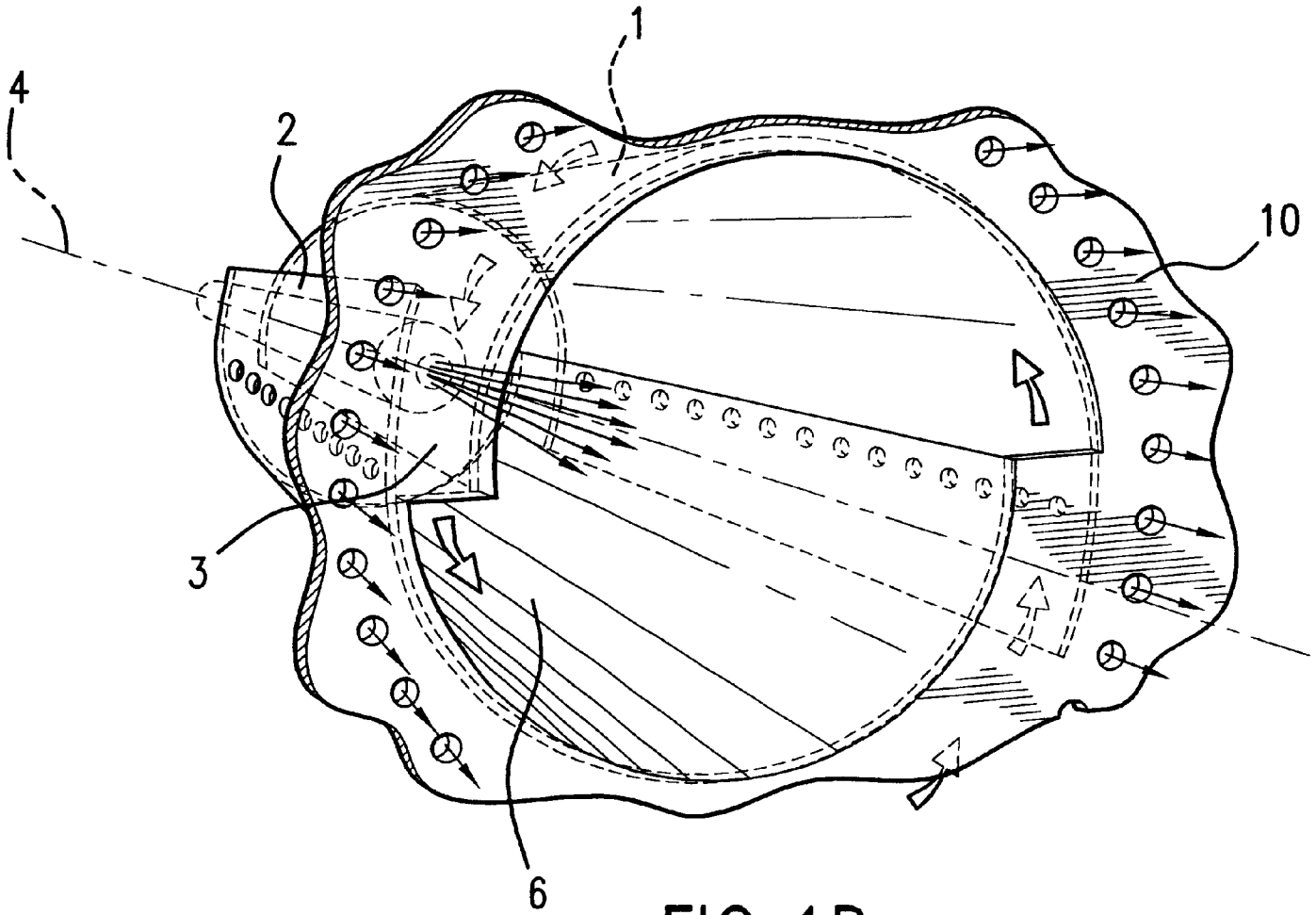
FIG. 1B PRIOR ART
FIG. 1*b* shows another drawing of a burner in a simplified form.

FIGS. 1*a* and 1*b* show in a very schematic form the construction and function of a premix burner that is the starting point of the present invention.

The premix burner comprises two hollow, conically expanding partial bodies (1) and (2) arranged axis-parallel and offset relative to each other in such a way that they form tangential slits (3) in two overlapping areas located in a mirror-image opposite from each other. Although FIGS. 1*a* and 1*b* show, as an example, two conically expanding partial bodies (1) and (2), other configurations are also conceivable. These burners, for example, are not limited to the arrangement of two partial bodies (1) and (2), nor is their conical configuration obligatory. The expert will be aware of this. The gaps (3) resulting from the offset of the longitudinal axes are used as inlet channels through which the combustion air (5) flows tangentially into the burner chamber (6) during the operation of the burner. Injection openings (7) through which a preferably gaseous fuel is injected into the combustion air (5) that is flowing by are located along the tangential inlet channels (3). In the interest of good mixing, the fuel injection takes place preferably within the tangential inlet channel (3), immediately before the entrance into the burner chamber (6). The beginning part of the burner, which also may be constructed cylindrically (not shown), a central nozzle (8) for atomizing a liquid fuel is provided, the capacity and function of which nozzle depends on the burner parameters. The liquid fuel leaves the nozzle (8) at an acute angle and forms a cone-shaped fuel profile in the burner chamber (6), which fuel profile is enclosed and continuously broken down into a mixture by the tangentially entering combustion air (5) that changes into a swirl flow (9), which process can be supported by preheated combustion air (5) or by mixing in recycled waste gas. Alternatively, it is also possible to supply the nozzle (8) with gaseous fuel. On the Combustor side, the premix burner has a front palate (10)

functioning as an anchor for the partial bodies (1) and (2), which is provided with a number of drilled holes (11) for introducing air into the combustor (12). The fuel/air mixture passing through the burner chamber (6) in a swirl flow (9) reaches the optimum fuel concentration across the cross-section at the downstream end of the premixing section (13) at the burner mouth (14). When exiting from the burner, the swirl flow (9) bursts, forming a reverse flow zone (15) with a stabilizing effect for the flame front (17) functioning there. This aerodynamic flame stabilization quasi assumed the function of a flame holder. The feared failure of mechanical flame holders due to overheating, followed possibly by serious failures of machine sets, is therefore prevented. In addition, the flame does not lose any heat to the cold walls, except by radiation. This also aids in homogenizing the flame temperature and therefore contributes to lower noxious emissions and good combustion stability.

Figure 2A:
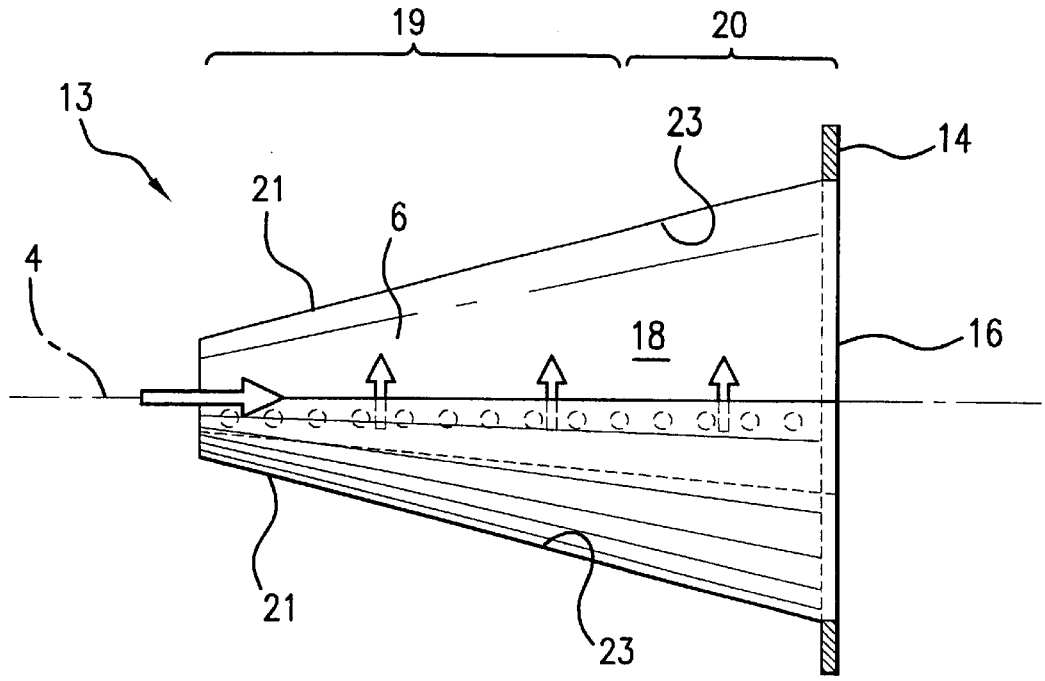
FIG. 2A PRIOR ART
FIGS. 2*a–d* show a very schematic portrayal of the concept of the invention using various forms of swirl flow generators.

According to the invention, measures are now provided to increasingly deform the swirl flow (9) inside the premix section (13) radially. It is preferred that this deformation takes place symmetrically. However, this is not mandatory. An important characteristic hereby is that this deformation is brought about by reducing the free flow cross-section (18). The wall (21) of the chamber (6) has in a downstream part (20) at least one section (22) that has a smaller slope with respect to the burner axis (4) than an upstream part (19). This means that the contour (21) of the burner chamber (6)—which, when seen over its cross-section, is approximately circular—is provided with sections (22) that are distributed over the circumference and deviate from the circular shape of the chamber contour (21) towards the center axis (4), i.e., constrict the chamber (6), as is shown in the longitudinal section schematically shown in FIGS. 2*a*–2*d*. In this context it was found to be advantageous, after all, that the deformation of the flow is simultaneously accompanied by an acceleration of the flow. This measure has a particularly beneficial effect on the stability of the burner. On the one hand, the cross-section shape of the flow (9) exiting from the burner, which shape deviates from the rotation symmetry, impairs the formation of coherent vortex structures and ultimately inhibits the generation of thermoacoustic oscillations thereby. On the other hand, the acceleration of the swirl flow (9) at the burner outlet (14) resulting from the absolute or relative constriction of the flow cross-section (18) brings about a stabilization of the reverse flow zone (15), inhibiting fluctuations of the reverse flow zone (15), the associated period heat release, and thus the development of thermoacoustic oscillations. This combination of equally acting effects results in synergy effects that permit, in a particularly advantageous manner, to increase the fluid-mechanical stability of a premix burner. FIGS. 2*a*–2*d* are intended to explain the concept of the invention using very schematic drawings. FIG. 2*a* shows a known swirl flow generator geometry that can be used to realize the invention in a particularly advantageous manner, whereby—as mentioned at another place—the conical configuration of the swirl flow generator (13) is not mandatory.

Figure 2B:
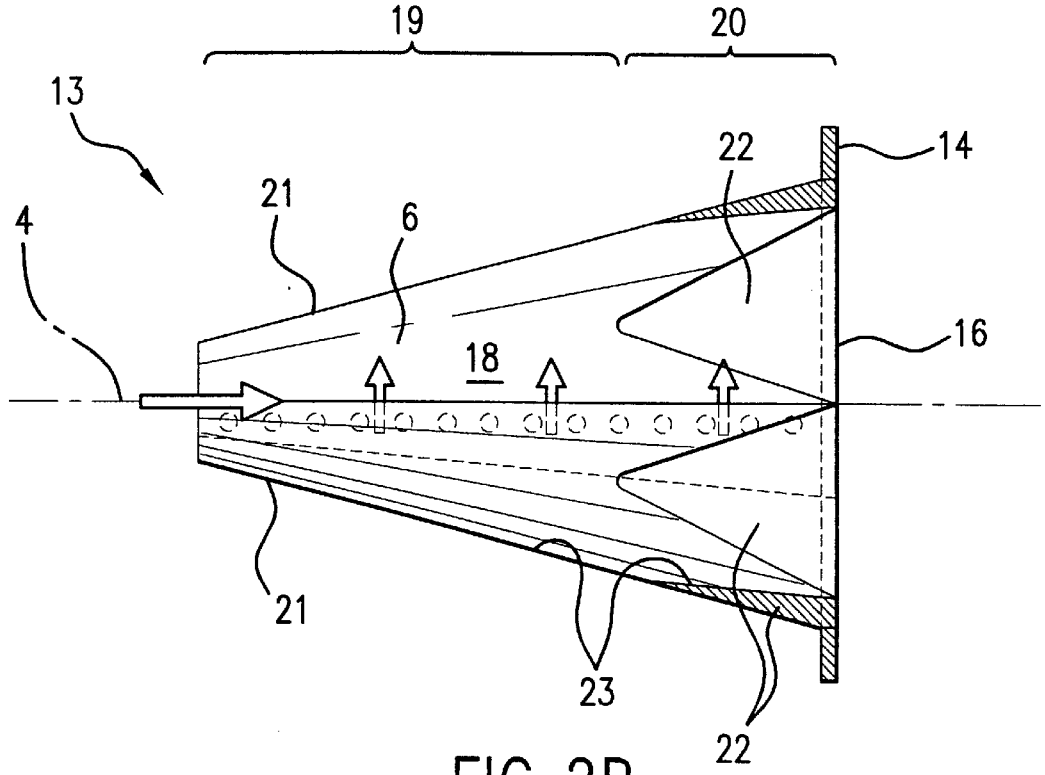
Figure 2C:
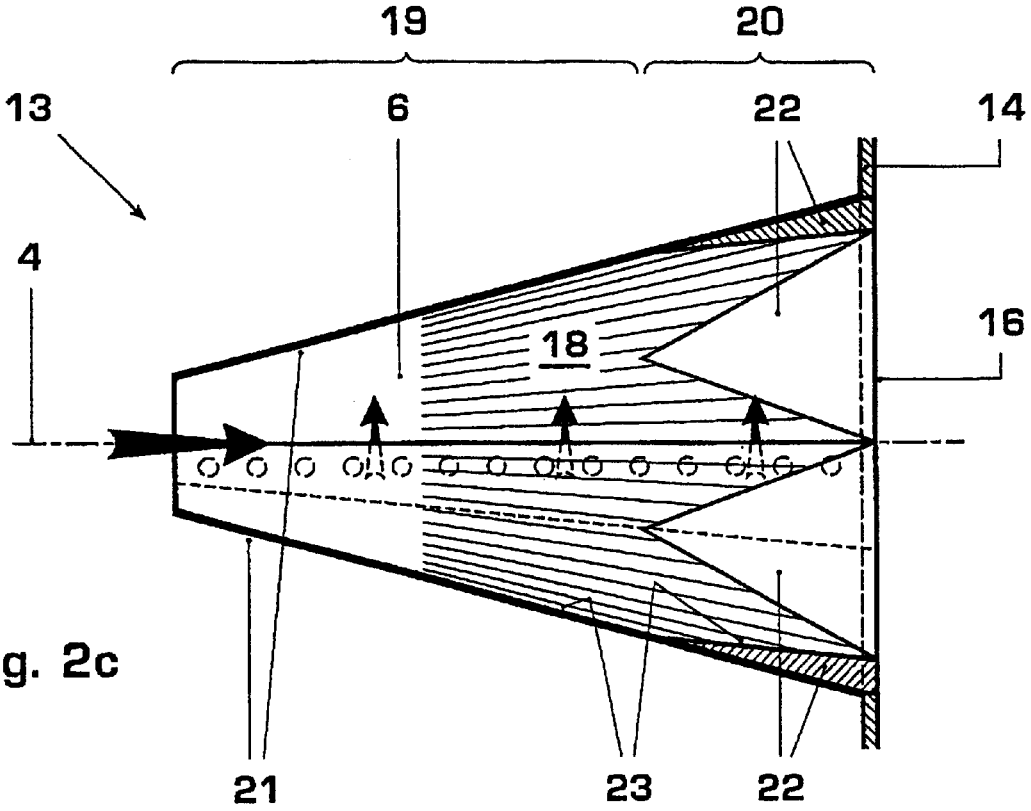
Figure 2D:
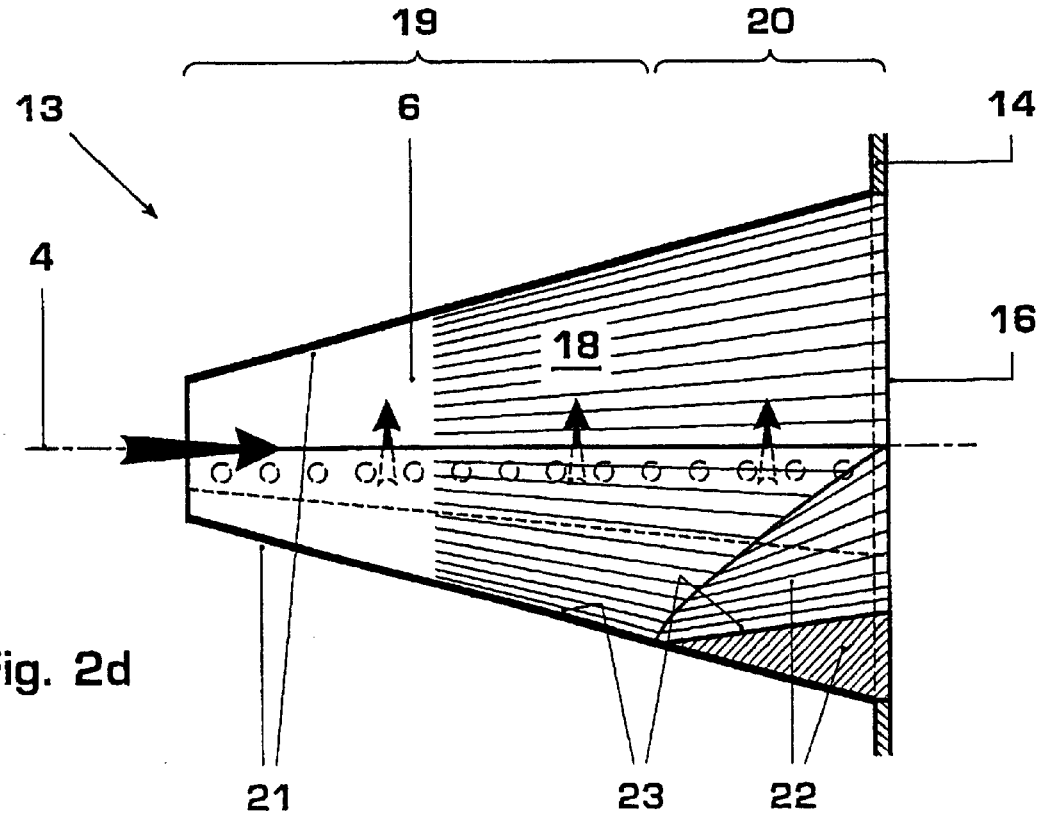

FIGS. 2*b*–2*d* symbolize the concept of the invention, which consists of angling the wall (21) of the burner chamber (6) in at least one circumferential section (22) by reducing the free flow cross-section (18) in the direction of the burner axis (4) in order to deform the flow profile. This may be accomplished symmetrically or asymmetrically with at least one such section (22) that constricts the flow cross-section. In a downstream part (20) of the chamber (6), which part (20) may start at approximately ⅔ of the axial length, the chamber wall (21) is bent in at least one circumferential section (22) at an angle in the range from 2° to 45°, in particular 5° to 15°, towards the burner axis (4). The expert also will be able to deduce from these schematic drawings another advantage of the invention, i.e., the possibility to retrofit existing burners with little expenditure. The sections (22) constricting the flow cross-section (18) can be realized with the help of flow-guiding installations (28) applied at a later time. FIGS. 3 to 7 show embodiments of burners designed according to the invention.

Figure 3:
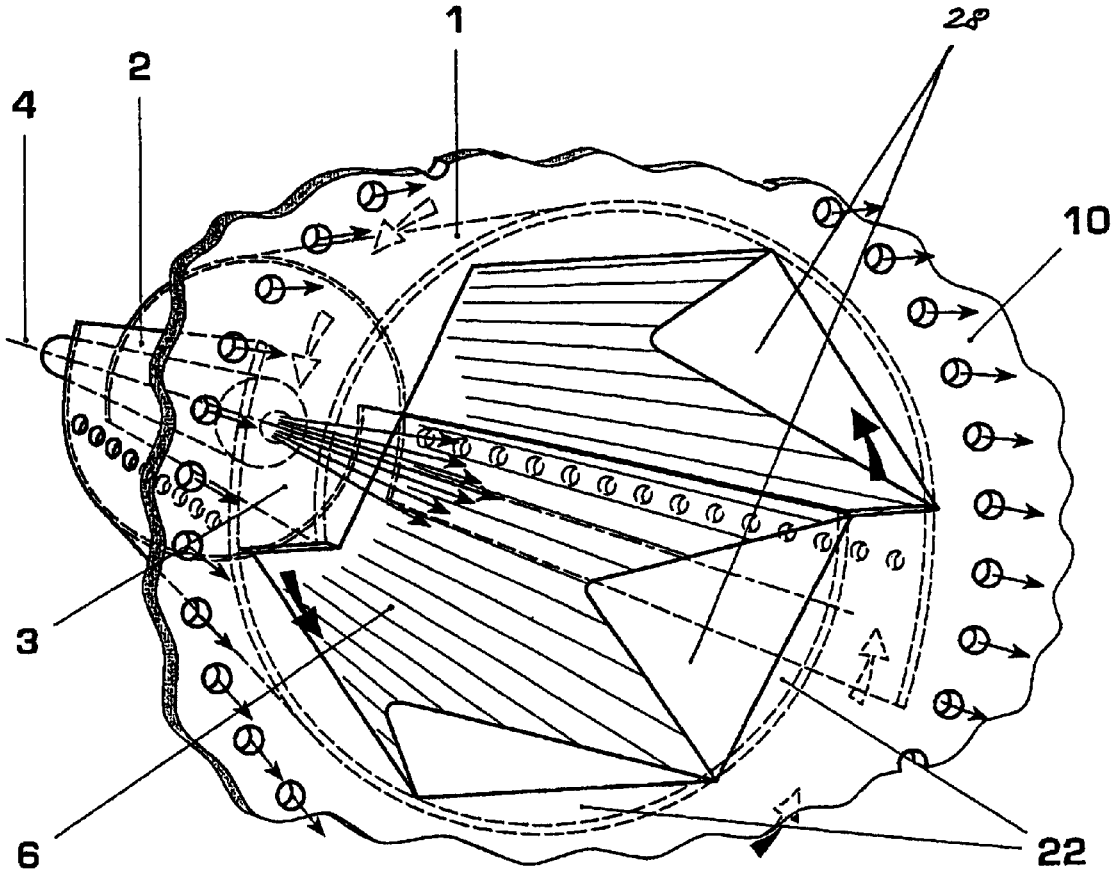
FIG. 3 shows an embodiment of burner modified according to the invention.

FIG. 3 shows a preferred variation of the invention, according to which the burner mouth (14) has a polygonal outlet contour (16). As can be seen most clearly from the schematic drawings of FIGS. 2*a*–2*d*, the conically expanding contour (23) of the burner chamber (6) is discontinued in a downstream end part (20) and is continued with a slope smaller than the previous part (19) in relation to the longitudinal axis (4). The term "smaller slope" also is supposed to include a progression parallel to the longitudinal axis (4) or a convergent progression, as shown in FIGS. 2*a*–2*d*. The expert has a number of possibilities available to realize this suggestion. According to one preferred embodiment, appropriately shaped plates (28) are welded into the shell-shaped partial bodies (1) and (2) of burners constructed according to the state of the art, whereby these plates represent—seen two-dimensionally—chords that cut sectors from the free flow cross-section (18) of the burner chamber (6). It is preferred that for each partial body (1) or (2) preferably one to four such plates (28) are welded onto the inside wall (21). In new burners, the wall contour is shaped during the manufacturing process.

Figure 4:
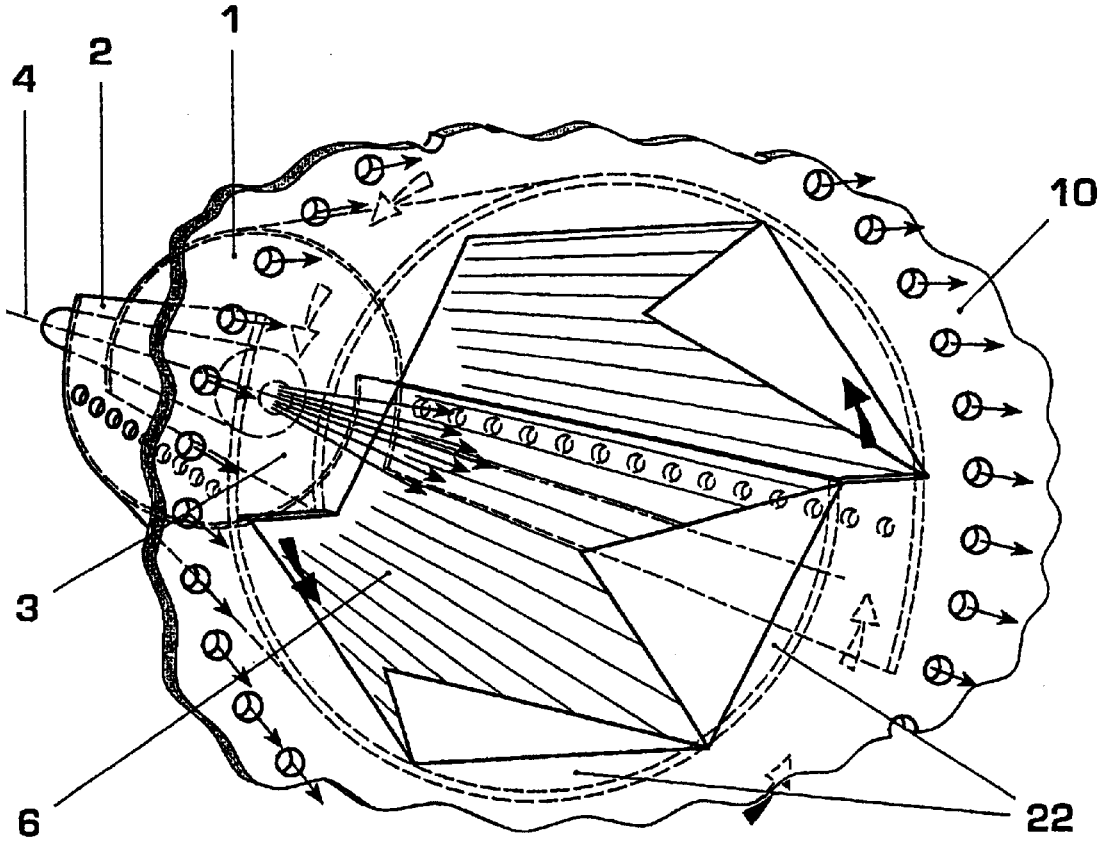
FIG. 4 shows a burner according to an embodiment of the invention having sections of the chamber wall that constrict the flow cross-section.
Figure 5A:
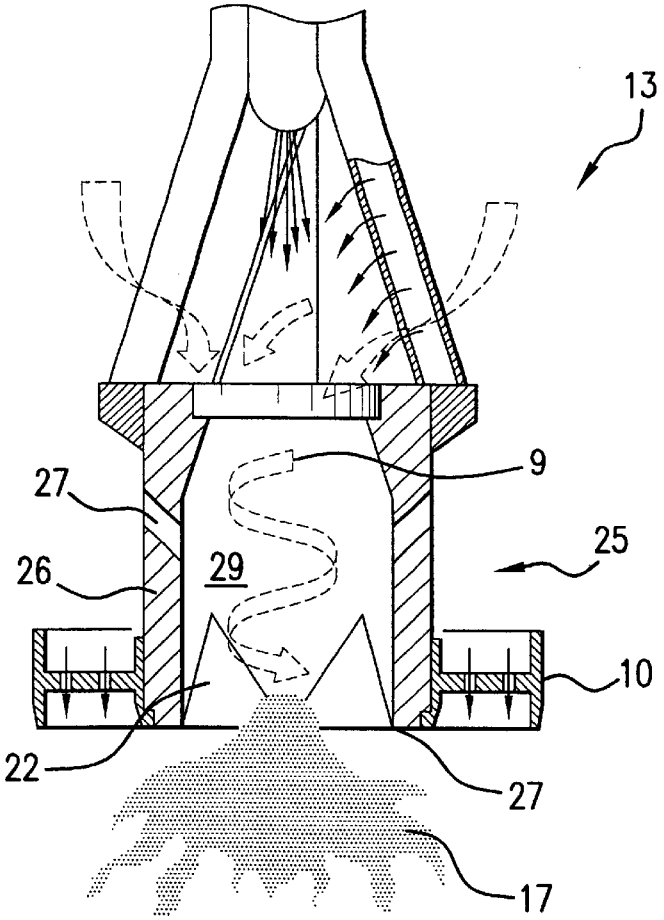
FIGS. 5*a* and 5*b* show an axial cross-section and an end view of a premix burner according to an embodiment of the invention having a mixing section that is rotationally symmetrical about a central axis.
Figure 5B:
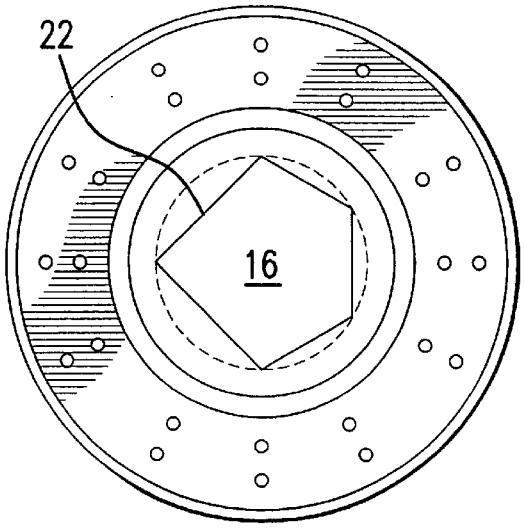

According to another embodiment seen from FIG. 4 in connection with FIG. 2*c*, the burner is constructed in an upstream part (19) in an actually known manner of two partial bodies (1) and (2) with an essentially circular cross-section that are stacked inside each other in an offset manner. In a transitional area, at approximately ⅔ of the axial length, the inside wall (21) changes from its essentially circular contour to a polygonal one that becomes increasingly more distinct in its further progression towards the burner mouth (14). These sections (22) of the chamber wall (21) that constrict the flow cross-section (18) like chords have less of a divergence in relation to the longitudinal axis (4) compared to the upstream parts (19) of the chamber wall (6). The term "less divergence" hereby shall also include the possibility of a parallel or convergent progression relative to the longitudinal axis (4). When viewing the cross-section, the constricting sections (22) as a rule have a linear contour. However, a slightly convex or concave progression is also possible. A convex progression is advantageous especially is only a small number or only one or two of such sections (22) are provided.

Another embodiment, not shown in a figure, consists of not providing the burner chamber (6), even in its upstream part (19), with a circular cross-section, but to equip the burner with a chamber (6) with a continuously non-rotation-symmetrically contoured chamber (6). This embodiment is particularly suitable for polygonal contours (23) of the chamber cross-section (18).

From the state of the art, it is known per se, to fit burners, as they were defined previously, for the purpose of better mixing and flame positioning for difficult fuels with nozzles (24) or mixing pipes (25) that follow the swirl flow generator (13). Even for these types of burner variations, the invention can be used to increase the fluid-mechanical stability of such burners by interfering with the flow instabilities and producing a smudged time delay of the fuel from the injection site to the flame.

Figure 6B:
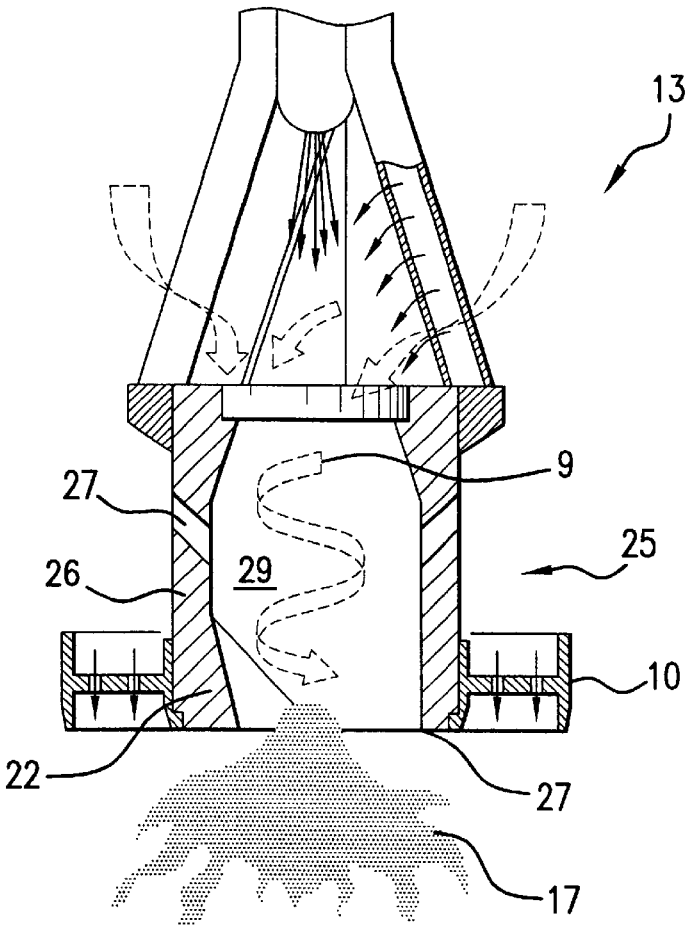
FIGS. 6*a* and 6*b* show an axial cross-section and an end view of a premix burner according to an embodiment of the invention having a mixing section that is rotationally asymmetrical about a central axis.
Figure 6A:
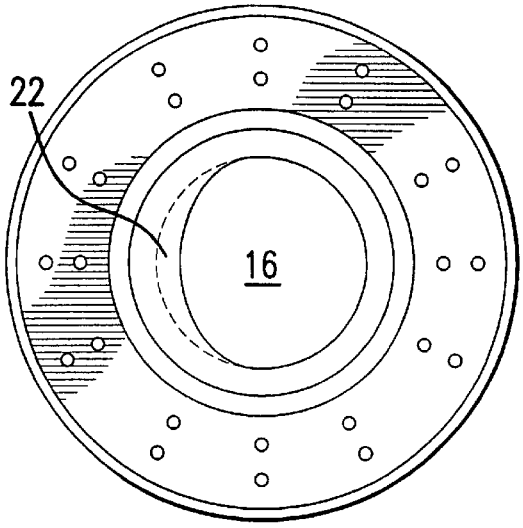

FIGS. 5*a*, 5*b*, 6*a* and 6*b* show a premix burner consisting of a swirl flow generator (13) for a combustion air stream (5) and means for injecting at least one fuel, whereby downstream from the swirl flow generator (13) a mixing section (25) is located. In the housing (26) surrounding the mixing section (25), inlet openings (27) for injecting an additional combustion air amount can be located evenly distributed over the circumference so as to extend at an acute angle to the longitudinal axis (4). It is preferred that in an area downstream from the inlet opening (27), the rotation-symmetrical flow cross-section of the mixing section (25) is deflected by sections (22) that construct the free circumference (29) and is radially deformed. The outlet opening (16) takes on a polygonal cross-section shape, composed of a plurality of linear sections (22). Very promising are outlet contours (16) in the form of a regular or irregular polygon. The individual, linear sections (22) of the outlet edge (27) span the outlet opening (16) of the burner. However, this linearity, as already mentioned before, is not mandatory, and these sections (22) also can be convex or concave. FIGS. 6*a* and 6*b* indicate a convex wall section (22) with an asymmetrical arrangement.

Figure 7B:
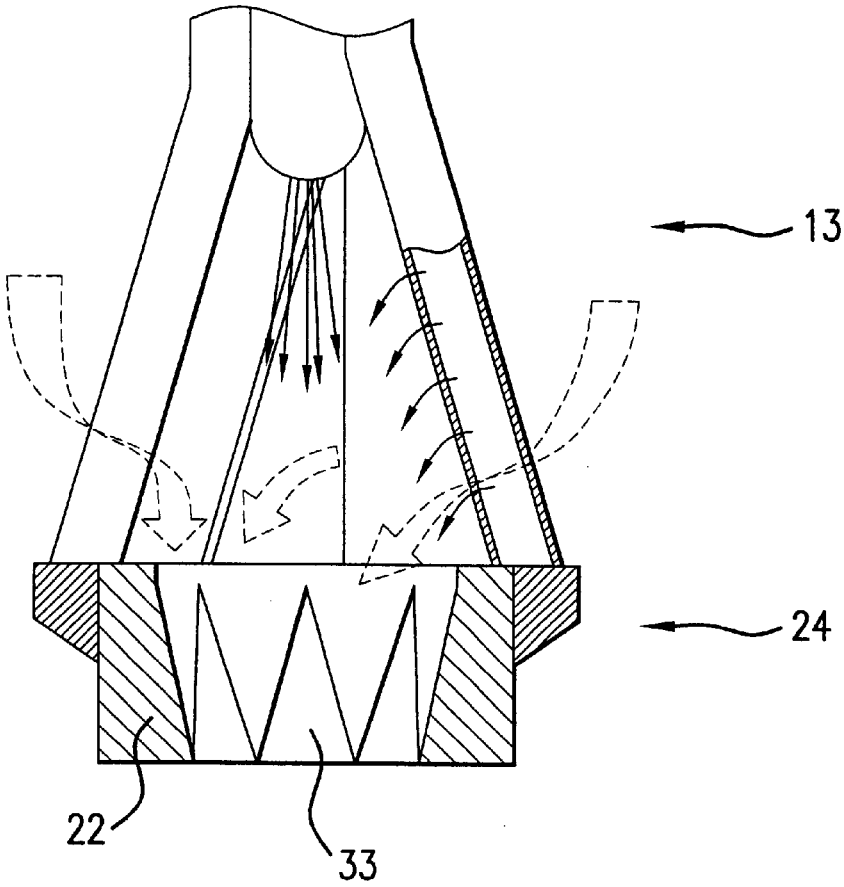
FIGS. 7*a* and 7*b* show an axial cross-section and an end view of a premix burner according to an embodiment of the invention having a cylindrical or convergent nozzle section at the downstream burner end.
Figure 7A:
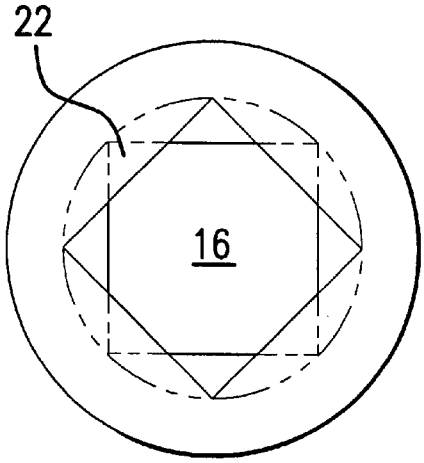

FIGS. 7*a* and 7*b*, show an embodiment with a cylindrical or convergent nozzle section (24) at the downstream burner end. According to the state of the art, these downstream nozzles (24) primarily have the function of accelerating the flow at the burner outlet and thus stabilize the reverse flow zone (15). According to one embodiment of the invention, this desirable acceleration through a reduction in the cross-section that starts in flow direction and increases is achieved by constricting this nozzle section (24) in flow direction from an essentially circular cross-section shape to another cross-section shape, for example, a regular or irregular polygon or oval.

Figure 8:
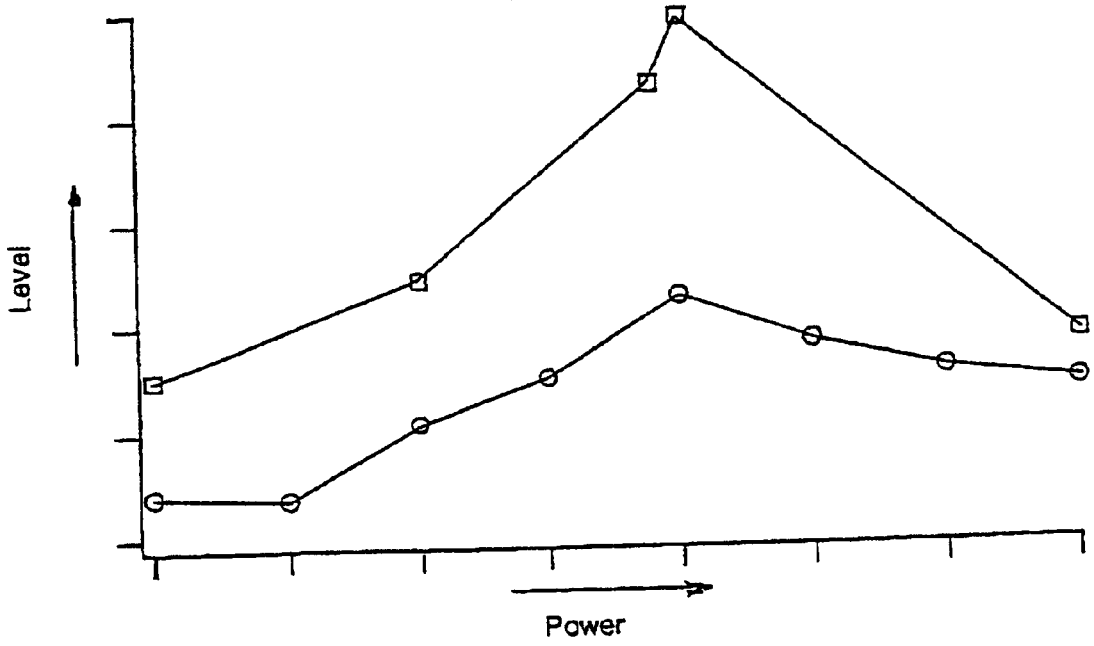
FIG. 8 shows a portrayal of the suppression of combustion oscillations by suppressing flow vortices in a burner.

FIG. 8 shows a diagram that shows the combustion power of the burner according to FIG. 3 along the abscissa, and a scale quantifying the formation of thermoacoustic oscillations created as a result of coherent structures within the flow inside the burner along the ordinate. The thermoacoustic oscillations shown are in the 100 Hz range. If a burner with conventional burner outlet according to the embodiment in FIG. 1 (line with squares) is compared with a burner outlet according to the invention as shown in the embodiment in FIG. 3 (line with circles), it is clear that in the latter significantly less thermoacoustic oscillations are created.

The previously described embodiments should in no way be seen in a sense that would limit the invention. They are instructive and should be understood as an outline of the many possible embodiments of the invention as characterized in the claims.

LIST OF REFERENCE SYMBOLS

1 partial body
2 partial body
3 tangential combustion air inlet channel
4 burner axis
5 combustion air
6 burner chamber
7 injection openings for fuel
8 central fuel nozzle
9 swirl flow
10 front plate
11 cooling air holes
12 combustor
13 swirl flow generator, premixing section
14 burner mouth
15 reverse flow zone
16 outlet cross-section into combustor
17 flame front
18 flow cross-section of burner chamber
19 upstream part of burner chamber
20 downstream part of burner chamber
21 wall of burner chamber
22 wall section
23 inside contour of burner chamber
24 burner nozzle
25 mixing section
26 mixing section housing
27 outlet edge
28 installations
29 flow cross-section in the mixing section
30 wall of mixing section
31 upstream part of mixing section
32 downstream part of mixing section
33 flow cross-section of burner nozzle
34 wall of nozzle
35 upstream part of nozzle
36 downstream part of nozzle

What is claimed is:

1. A premix burner for use in a heat generator, comprising:

a swirl flow generator with means for the tangential introduction of a combustion air stream into a chamber of the swirl flow generator as well as means for introducing at least one gaseous and/or liquid fuel into the combustion air stream with concomitant formation of a swirl flow with an axial movement component up to a mouth of the premix burner, wherein the chamber contour changes in the flow direction from a cross-section that is largely rotation-symmetrical about a central longitudinal axis of the burner into a cross-section that is non-rotation-symmetrical about the central longitudinal axis, and wherein, when seen across the circumference, at least one section of the chamber wall in a downstream end part assumes a smaller slope in relation to the burner longitudinal axis than in an upstream part.

2. The premix burner as claimed in claim 1, comprising at least two hollow, conically expanding partial bodies and stacked inside each other coaxially to the longitudinal axis, the center axes of which partial bodies extend offset to each other, and the walls of which form tangential inlet channels for combustion air in an overlapping area, and comprising also at least one fuel nozzle inside the chamber formed by the partial bodies, wherein the flow-limiting wall of at least one of the partial bodies has in a downstream end part at least one circumferential section that has a smaller pitch in relation to the burner longitudinal axis than in an upstream part.

3. The premix burner as claimed in claim 1, wherein a plurality of such sections exist distributed over the circumference.

4. The premix burner as claimed in claim 3, wherein the burner has a polygonal contour in one end part, including the burner mouth.

5. The premix burner as claimed in claim 4, wherein the burner has the contour of a regular polygon.

6. The premix burner as claimed in claim 4, wherein the burner has the contour of an irregular polygon.

7. The premix burner as claimed in claim 2, wherein at least one of the partial bodies delimits a convex outlet cross-section that deviates from a circular shape.

8. The premix burner as claimed in claim 7, wherein the partial bodies have an at least approximately symmetrical outlet cross-section.

9. The premix burner as claimed in claim 1, wherein the flow-limiting wall of the burner chamber changes steadily between the upstream part and downstream end part from one slope to the other.

10. The premix burner as claimed in claim 1, wherein the downstream end part includes approximately the last third of the length of the burner chamber.

11. The premix burner as claimed in claim 1, wherein in a downstream part plates that limit the free flow cross-section are welded or attached in another suitable manner on the wall.

12. The premix burner as claimed in claim 3, wherein the number of such sections distributed over the circumference is in the range from 2 to 8.

13. The premix burner as claimed in claim 1, wherein the flow-limiting wall of the burner chamber changes in one or more steps between the upstream part and downstream end part from one slope to the other.

14. A premix burner, comprising:

at least two hollow, conically expanding partial bodies stacked inside each other coaxially to a longitudinal axis of the burner, the center axes of which partial bodies extend offset to each other, and the walls of which form tangential inlet channels for combustion air in an overlapping area, and comprising also at least one fuel nozzle inside a chamber formed by the partial bodies, and furthermore comprising a mixing section downstream from a swirl flow generator that is formed by the partial bodies, where said mixing section is provided inside a first initial part with transition channels extending in flow direction for the swirl flow formed in the chamber and ends at a separation edge into a combustor, wherein a free flow cross-section of the mixing section is reduced in the flow direction with a simultaneous change from a cross-section shape that is largely rotation-symmetrical about the central longitudinal axis of the burner to a cross-section shape that is largely non-rotation-symmetrical about the longitudinal axis in that at least one circumferential section of the wall delimiting the mixing section has a smaller distance from the fuel nozzle longitudinal axis in a downstream part than in an upstream part.

15. A premix burner, comprising:

a swirl flow generator with means for the tangential introduction of a combustion air stream into a chamber of the swirl flow generator as well as means for introducing at least one gaseous and/or liquid fuel into the combustion air stream with concomitant formation of a swirl flow with an axial movement component towards a mouth of the burner and a burner nozzle at a combustor end of the burner, wherein a free flow cross-section of the burner nozzle is reduced in the flow direction with a simultaneous transition from a cross-section that is largely rotation-symmetrical about a longitudinal axis of the burner into a cross-section that is largely non-rotation-symmetrical about the longitudinal axis, and at least one circumferential section of a wall of the burner nozzle has a smaller distance from the nozzle longitudinal axis in a downstream part than in an upstream part.

* * * * *